US008011527B2

(12) United States Patent
Forrest et al.

(10) Patent No.: US 8,011,527 B2
(45) Date of Patent: Sep. 6, 2011

(54) CAN END WITH COUNTERSINK

(75) Inventors: Randall G. Forrest, Park Ridge, IL (US); Timothy L. Turner, Port Charlotte, FL (US)

(73) Assignee: Rexam Beverage Can Company, Chicago, IL (US)

( * ) Notice: Subject to any disclaimer, the term of this patent is extended or adjusted under 35 U.S.C. 154(b) by 689 days.

(21) Appl. No.: 11/837,195

(22) Filed: Aug. 10, 2007

(65) Prior Publication Data

US 2009/0039091 A1 Feb. 12, 2009

(51) Int. Cl.
*B65D 6/28* (2006.01)
*B65D 8/04* (2006.01)
*B65D 1/42* (2006.01)

(52) U.S. Cl. ..... 220/623; 220/610; 220/641; 220/643; 220/646; 220/648; 220/651; 220/654; 220/906

(58) Field of Classification Search ..... 220/610, 220/623, 641, 643, 645, 646, 648, 651, 654, 220/906
See application file for complete search history.

(56) References Cited

U.S. PATENT DOCUMENTS

| | | | |
|---|---|---|---|
| 3,186,583 | A | 6/1965 | Zundel |
| 3,434,623 | A | 3/1969 | Cookson |
| 3,525,455 | A | 8/1970 | Saunders |
| 3,705,563 | A | 12/1972 | Elser |
| 3,765,352 | A | 10/1973 | Schubert et al. |
| 3,837,524 | A | 9/1974 | Schubert et al. |
| 3,853,080 | A | 12/1974 | Zundel |
| 3,868,919 | A | 3/1975 | Schrecker et al. |
| 3,871,314 | A | 3/1975 | Stargell |
| 3,905,513 | A | 9/1975 | Klein |
| 3,941,277 | A | 3/1976 | McKinney et al. |
| 3,945,334 | A | 3/1976 | Ostrem et al. |
| 3,990,376 | A | 11/1976 | Schubert et al. |
| 4,031,837 | A | 6/1977 | Jordan |
| 4,055,134 | A | 10/1977 | Ostrem et al. |
| 4,084,721 | A | 4/1978 | Perry |
| 4,093,102 | A | 6/1978 | Kraska |
| 4,116,361 | A | 9/1978 | Stargell |
| 4,217,843 | A | 8/1980 | Kraska |
| 4,262,815 | A | 4/1981 | Klein |

(Continued)

FOREIGN PATENT DOCUMENTS

| | | |
|---|---|---|
| AU | 107340 | 5/1939 |

(Continued)

OTHER PUBLICATIONS

International Search Report mailed Oct. 13, 2008 in co-pending Application No. PCT/US2008/072594.

*Primary Examiner* — Anthony Stashick
*Assistant Examiner* — Madison L Wright
(74) *Attorney, Agent, or Firm* — Ungaretti & Harris LLP

(57) ABSTRACT

A can end for a two-piece beverage can is described. The can end has a center panel positioned about a vertical center axis. The center panel has a stay-on tab opening assembly located on a public side. A reinforcing bead surrounds the center panel. The reinforcing bead has an inner curved portion having a radius of curvature located radially inwardly from an outer curved portion having a radius of curvature. The radius of curvature of the outer curved portion is greater than the radius of curvature of the inner curved portion.

4 Claims, 3 Drawing Sheets

U.S. PATENT DOCUMENTS 4,324,343 A 4/1982 Moller
4,434,641 A 3/1984 Nguyen
4,448,322 A 5/1984 Kraska
4,571,978 A 2/1986 Taube et al.
4,577,774 A 3/1986 Nguyen
4,641,761 A 2/1987 Smith et al.
4,680,917 A 7/1987 Hambleton et al.
4,685,849 A 8/1987 LaBarge et al.
4,704,887 A 11/1987 Bachmann et al.
4,722,215 A 2/1988 Taube et al.
4,804,106 A 2/1989 Saunders
4,809,861 A 3/1989 Wilkinson et al.
4,832,223 A 5/1989 Kalenak et al.
4,991,735 A 2/1991 Biondich
5,046,637 A * 9/1991 Kysh ..... 220/610
5,069,355 A 12/1991 Matuszak
5,105,977 A 4/1992 Taniuchi
5,143,504 A 9/1992 Braakman
5,149,238 A 9/1992 McEldowney et al.
5,174,706 A 12/1992 Taniuchi
5,346,087 A 9/1994 Klein
5,645,189 A * 7/1997 Clowes ..... 220/623
5,823,730 A 10/1998 La Rovere
5,950,858 A 9/1999 Sergeant
5,964,366 A 10/1999 Hurst et al.
6,024,239 A 2/2000 Turner et al.
6,065,634 A 5/2000 Brifcani et al.
6,089,072 A 7/2000 Fields
6,234,337 B1 5/2001 Huber et al.
6,419,110 B1 7/2002 Stodd
6,460,723 B2 10/2002 Nguyen et al.
6,499,622 B1 12/2002 Neiner
6,516,968 B2 2/2003 Stodd
6,561,004 B1 5/2003 Neiner et al.
6,702,142 B2 3/2004 Neiner
6,736,283 B1 5/2004 Santamaria et al.
6,748,789 B2 * 6/2004 Turner et al. ..... 72/379.4
6,772,900 B2 8/2004 Turner et al.
6,848,875 B2 2/2005 Brifcani et al.
6,877,941 B2 4/2005 Brifcani et al.
6,935,826 B2 8/2005 Brifcani et al.
7,004,345 B2 2/2006 Turner et al.
7,036,348 B2 5/2006 McClung
7,100,789 B2 * 9/2006 Nguyen et al. ..... 220/623
7,174,762 B2 2/2007 Turner et al.
7,370,774 B2 * 5/2008 Watson et al. ..... 220/619
2001/0037668 A1 11/2001 Fields
2002/0050493 A1 5/2002 Ball et al.
2002/0158071 A1 10/2002 Chasteen et al.
2003/0121924 A1 7/2003 Stodd
2003/0173367 A1 9/2003 Nguyen et al.
2004/0065663 A1 4/2004 Turner et al.
2004/0074911 A1 4/2004 Stodd
2004/0140312 A1 7/2004 Neiner
2004/0200838 A1 10/2004 Turner et al.
2004/0206764 A1 10/2004 Gardiner
2004/0211780 A1 10/2004 Turner et al.
2004/0238546 A1 12/2004 Watson
2005/0006388 A1 1/2005 Turner et al.
2005/0006395 A1 1/2005 Reed
2005/0029269 A1 2/2005 Stodd et al.
2005/0115976 A1 6/2005 Watson
2005/0247717 A1 11/2005 Brifcani et al.
2005/0252922 A1 11/2005 Reed
2006/0096994 A1 5/2006 Turner et al.

FOREIGN PATENT DOCUMENTS

DE 2303943 5/1974
DE 2554264 6/1977
DE 8228681 10/1983
EP 0 340 955 A1 11/1989
GB 422052 6/1934
WO WO-03016155 2/1993
WO WO-9637414 11/1996
WO WO-9834743 8/1998
WO WO-0141948 6/2001
WO WO-0200512 1/2002
WO WO-0243895 6/2002
WO WO-02057137 7/2002
WO WO-02057148 7/2002

* cited by examiner

CAN END WITH COUNTERSINK

TECHNICAL FIELD

The invention relates to can ends for two-piece beverage containers. More particularly, the present invention relates to such a can end having a recessed annular countersink with a compound radius structure.

BACKGROUND OF THE INVENTION

Common easy open end closures for beer and beverage containers have a central or center panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures, or can ends, for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

One goal of the can end manufacturers is to provide a buckle resistant end. Another goal of the manufacturers of can ends is to reduce the amount of metal in the blank which is provided to form the can end while at the same time maintaining the strength of the end. A number of recent disclosures, including U.S. Pat. Nos. 6,736,283, 6,460,723, 6,516,968, 6,419,110, 6,065,634, 6,848,875, 6,877,941, 6,935,826, 6,561,004, 6,499,622, 6,702,142, and US Publication Nos. 2004/0074911, 2003/0121924, 2004/0238546, 2005/0115976, 2005/0247717, 2005/0252922, 2005/0006395, 2004/0140312, 2003/0173367, 2002/0158071, 2005/0029269, are directed to achieving these goals by altering the angles and/or orientations of the chuck wall.

In addition to the references set forth above, U.S. Pat. No. 4,809,861 describes a can end having a compound radius within a countersink groove. The countersink groove, often referred to as a reinforcing bead, annular reinforcing bead, anti-peaking bead, etc., is a generally has a generally U-shaped configuration, and is designed to increase the buckle strength of the can end. A compound radius structure is described as unequal radii of curvature of the inner and outer annular curved portions at the bottom of the countersink. The '861 patent describes an outer radius of curvature being approximately one half of an inner radius of curvature to produce a buckle resistant can end.

Yet another goal of the manufacturers is to produce a can end that will be resilient when dropped from a height after being seamed to a filled can body. It is believed that the specific compound radius described in U.S. Pat. No. 4,809,861 does not increase resiliency to dropping.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY OF THE INVENTION

One aspect of the present invention is directed to a can end for a two-piece beverage can. The can end comprises a center panel, a reinforcing bead, and a curl. The center panel is positioned about a vertical center axis. The reinforcing bead surrounds the center panel and has a first curved portion having a first radius of curvature located radially inwardly from a second curved portion having second radius of curvature. The second radius of curvature is greater than the first radius of curvature. The curl is joined to the bead.

The reinforcing bead may be recessed below the center panel and/or concave. The reinforcing bead may further include an angled wall which joins the first curved portion with the second curved portion. The wall extends upwardly and outwardly relative to the vertical center axis. The reinforcing bead may be joined to a peripheral edge of the center panel through a panel radius. The panel radius has a height above the first curved portion greater than a height of the second curved portion above the first curved portion.

The first radius of curvature may have a center point located radially outwardly of the peripheral edge of the center panel.

The second radius of curvature may have a center point located radially inwardly of a center point of the first radius of curvature.

The second curved portion may be elevated relative to the first curved portion.

The first radius of curvature of the first curved portion may have a first center point, and the second radius of curvature of the second curved portion may have a second center point. The second center point may have a higher vertical height than the first center point.

Another aspect of the present invention provides a can end for a two-piece container. The can end comprises a center panel, a countersink, a wall, and a curl. The center panel is positioned about a vertical center axis. The center panel comprises a peripheral edge including a panel radius. The panel radius comprises a center of curvature located below a product side of the center panel. The countersink comprises an inner wall joined to the panel radius and extending downwardly relative thereto. A first curved portion has a first end joined to the inner wall. An angled wall is joined to a second end of the first curved portion and extends radially outwardly from the first curved portion. A second curved portion is joined to the angled wall and extends upwardly and radially outwardly therefrom. The wall extends upwardly from the countersink. The curl is joined to the wall.

The first curved portion may have a first radius of curvature, and the second curve may have a second radius of curvature. The second radius of curvature may be greater than the first radius of curvature. The second radius of curvature may have a center point located radially inwardly of a center point of the first radius of curvature. The center point of the first radius of curvature may be located radially outwardly of the first curved portion, and the center point of the second radius of curvature may have a center point located radially inwardly of the second curved portion.

The angled wall may extend both radially outwardly and upwardly relative to the first curved portion.

Another aspect of the present invention provides a can end for a two-piece container. The can end comprises a center panel, a countersink bead, a wall, and a curl. The center panel positioned about a vertical center axis. The center panel comprises a peripheral edge including a panel radius. The panel radius comprises a center of curvature below a product side of the center panel. The countersink bead comprises an inner wall joined to the panel radius and extending downwardly relative thereto. A first curved portion directs the countersink bead radially outwardly relative to the vertical center axis, and a second curved portion is joined to the first curved portion and located radially outwardly therefrom. The second curved portion has a lowermost vertical extent higher than a lowermost vertical extent of the first curved portion. The wall extends upwardly from the countersink. The curl is joined to the wall.

The second curved portion may be located below a vertical extent of the panel radius.

The wall may be integral with an outer wall of the countersink bead. A junction between the outer wall of the countersink bead and the wall has a height substantially equal to the height of the panel radius.

Another aspect of the present invention provides a can end for a two-piece beverage container. The can end comprises a center panel, an annular countersink, a circumferential wall, and a curl. The center panel is positioned about a vertical center axis. The center panel includes a means for opening the center panel on a public side and a peripheral edge portion including a panel radius. The annular countersink surrounds the peripheral edge of the center panel. The annular countersink includes an inner wall integral with the panel radius and extending downwardly to a base of the annular countersink. The base includes a first annular curved portion having a first radius of curvature, an upwardly extending annular base wall having a first end integral with the first annular curved portion and a second end portion integral with a second annular curved portion having a second radius of curvature. The circumferential wall is integral with the annular countersink and extends upwardly therefrom. The curl is joined to an uppermost end of the circumferential wall.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
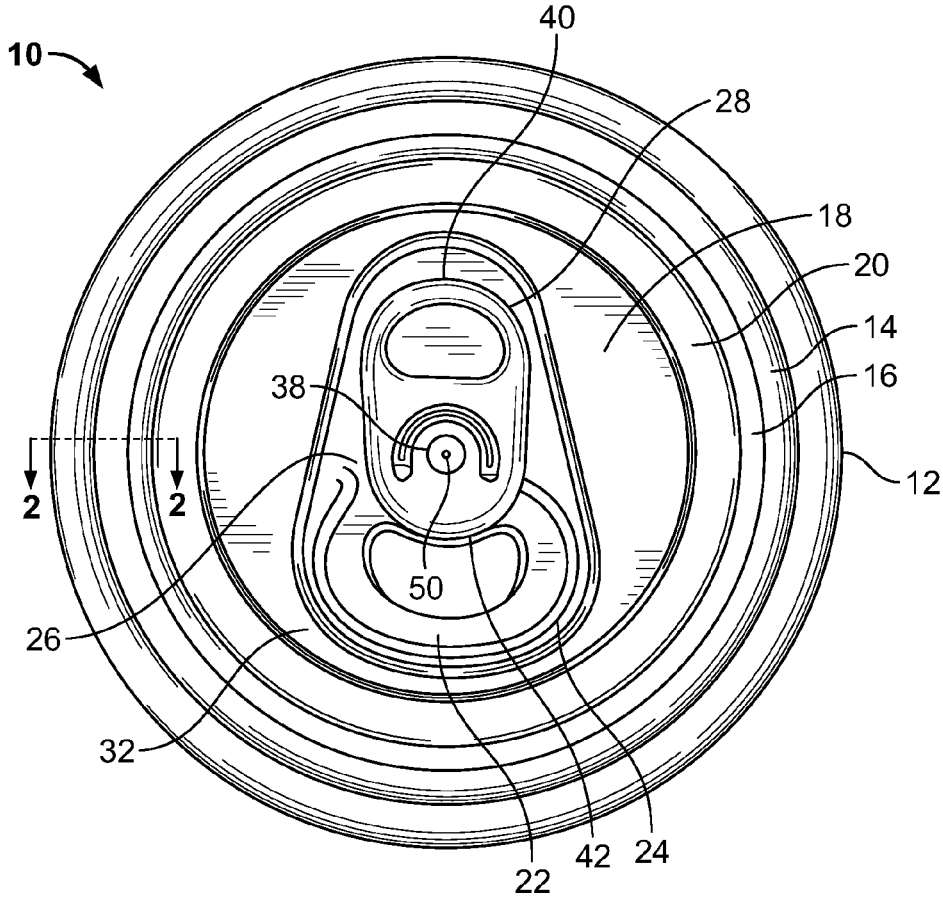
FIG. 1 is a top view of a can end of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a can end for a two-piece beverage can. The container end of the present invention is a stay-on-tab end member 10 with improved physical properties including strength. The can end of the present invention has a novel annular countersink or reinforcing bead located about the peripheral edge of a center panel. It is believed that the annular countersink of the present invention improves the overall performance/strength of the can end, especially when the can end is seamed to a pressurized fluid-filled can body, forming a finished two-piece container, and dropped from a given height. The can end of the present invention is particularly suited to withstand damage incurred during such dropping. Such performance is required by beverage makers in the industry today Referring to FIG. 1, the end member 10 for a container (not shown) has a curl 12, a circumferential wall 14, an annular reinforcing segment as illustrated an annular reinforcing bead also called an anti-peaking bead or annular countersink 16, and a center or central panel wall 18.

The container is typically a drawn and ironed metal can such as the common beer and beverage containers, usually constructed from a thin sheet of aluminum or steel that is delivered from a large roll called coil stock of roll stock. End closures for such containers are also typically constructed from a cut edge of thin sheet of aluminum or steel delivered from coil stock, formed into blank end, and manufactured into a finished end by a process often referred to as end conversion. In the embodiment shown in the figures, the end member 10 is joined to a container by the curl 12 which is joined to a mating curl of the container body. The seaming curl 12 of the end closure 10 is integral with the circumferential wall 14 which is joined to a radially outer peripheral edge portion 20 of the center panel 18 by the annular countersink 16. This type of means for joining the end member 10 to a container body is presently the typical means for joining used in the industry, and the structure described above is formed in the process of forming the blank end from a cut edge of metal sheet, prior to the end conversion process. However, other means for joining the end member 10 to a container may be employed with the present invention.

The center panel 18 and has a means for opening the end 10. The means for opening the end 10 may include a displaceable closure member or, as shown in FIG. 1, a tear panel 22 defined by a curvilinear frangible score 24 and a non-frangible hinge segment 26. The hinge segment 26 is defined by a generally straight line between a first end and a second end of the frangible score 24. The tear panel 22 of the center panel 18 may be opened, that is the frangible score 24 may be severed and the tear panel 22 displaced at an angular orientation relative to the remaining portion of the center panel 18, while the tear panel 22 remains hingedly connected to the center panel 18 through the hinge segment 26. In this opening operation, the tear panel 22 is displaced at an angular deflection, as it is opened by being displaced away from the plane of the panel 18.

The frangible score 24 is preferably a generally V-shaped groove formed into a public side 32 of the center panel 18. A residual is formed between the V-shaped groove and a product side 34 of the end member 10.

The end member 10 has a tab 28 secured to the center panel 18 adjacent the tear panel 22 by a rivet 38. The rivet 38 is formed in the typical manner.

During opening of the end member 10 by the user, the user lifts a lift end 40 of the tab 28 to displace a nose portion 42 downward against the tear panel 22. The force of the nose portion 42 against the tear panel 22 causes the score 24 to fracture. As the tab 28 displacement is continued, the fracture of the score 24 propagates around the tear panel 22, preferably in progression from the first end of the score 24 toward the second end of the score 24.

A shown in the figures, the center panel 18 is centered about a vertical center, or longitudinal, axis 50. The curl 12 defines an outer perimeter of the end member 10 and is integral with the circumferential wall 14. The circumferential wall 14 extends downwardly from the curl 12 at an angle. The circumferential wall 14 may be provided with a radius of curvature to improve performance within the forming tools used to form the end member 10. The radius of curvature helps prevent buckling within the tools as force is applied to the unfinished end member 10.

The center panel 18 has a height $H_{cp}$. The center panel height $H_{cp}$ is measured from a lowermost point on the annular countersink to the product side 34 of the peripheral edge 20 of the central panel 18.

The annular countersink 16 extends circumferentially about the center panel 18. One or more panel radii 54 join the radially outer edge 20 of the center panel 18 to a first portion inner wall 58 of the annular countersink 16. The panel radius 54 has a radius of curvature having a center point below the product side of the center panel. The inner wall 58 extends downwardly relative to the radially outer edge 20 of the center panel 18. The inner wall 58 may be angled with respect to a vertical axis on the order of ±10 degrees, i.e. angled radially inwardly or outwardly relative to the longitudinal axis 50. Accordingly, the inner wall 58 may extend downwardly and inwardly or downwardly and outwardly relative to the outer edge 20 of the center panel 18.

The countersink 16 further has a base. The base includes an annular inner curved portion 62 extending radially outwardly and downwardly relative to the inner wall 58 to direct the countersink 16 outwardly relative to the center panel and the vertical center axis 50. Accordingly, the inner curved portion 62 has a first end joined, preferably directly connected to as to be integral with, the inner wall 58 and a second end opposite the first end. The inner curved portion 62 has a radius of curvature $R_i$ having a center point $C_i$ located radially outwardly of the peripheral edge of the center panel.

Figure 2:
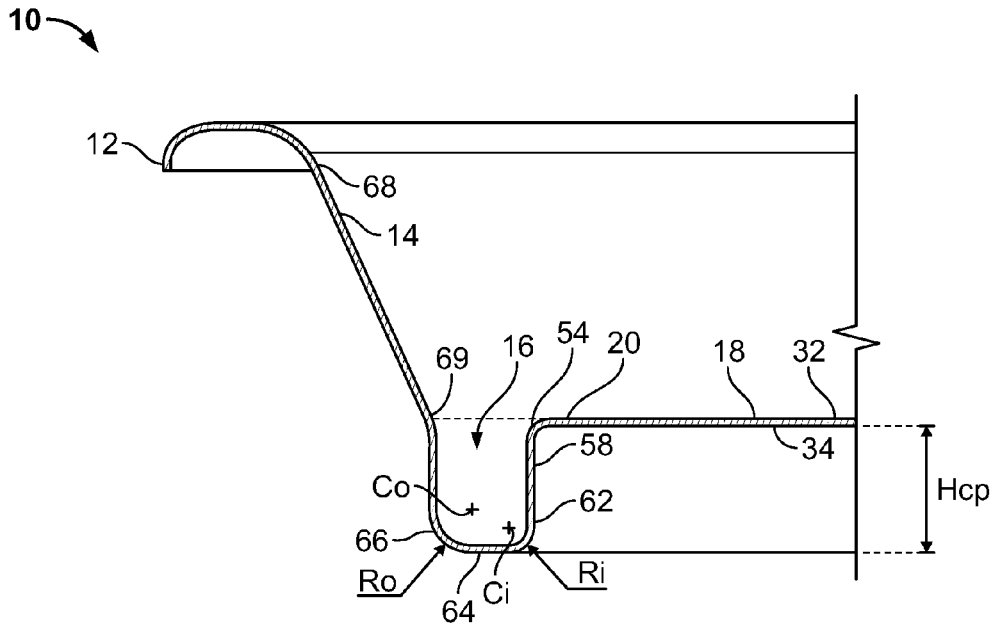
FIG. 2 is a partial cross-sectional view of a can end of the present invention.
Figure 2A:
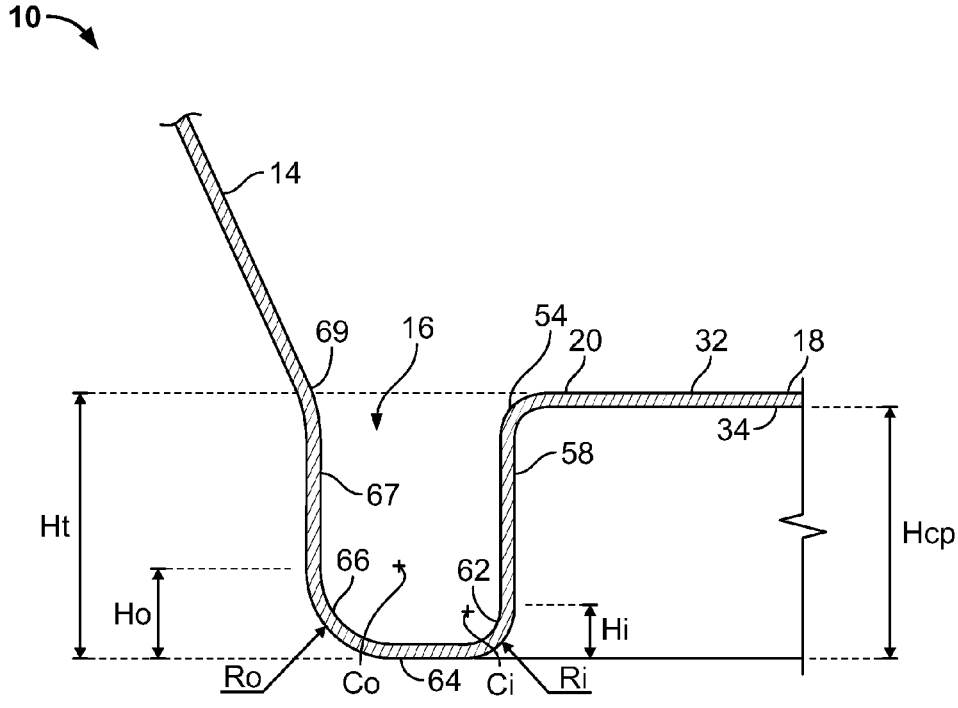
FIG. 2A is a magnified portion of the can end of FIG. 2
Figure 3:
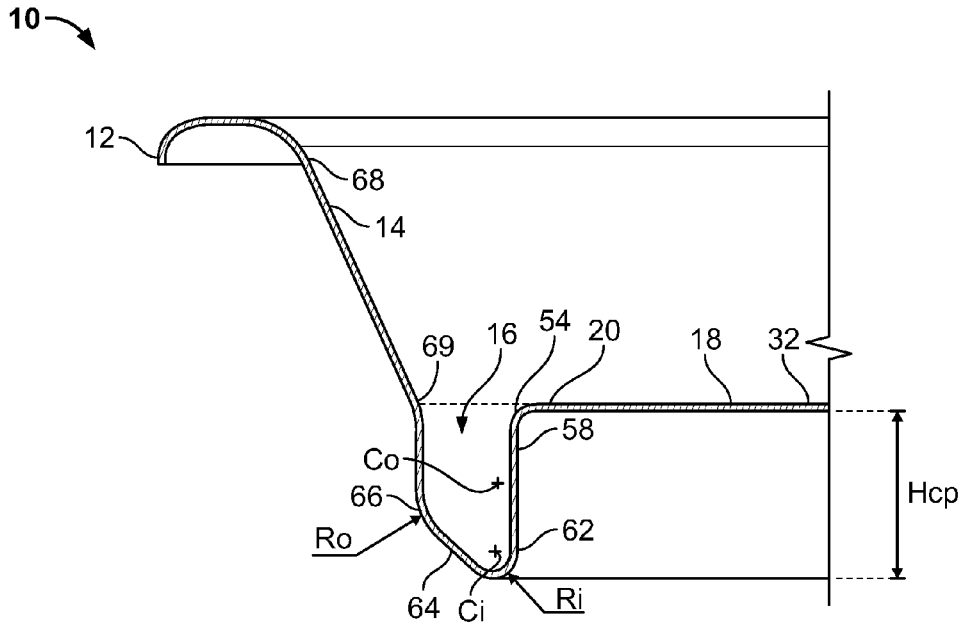
FIG. 3 is a partial cross-sectional view of a can end of the present invention.
Figure 3A:
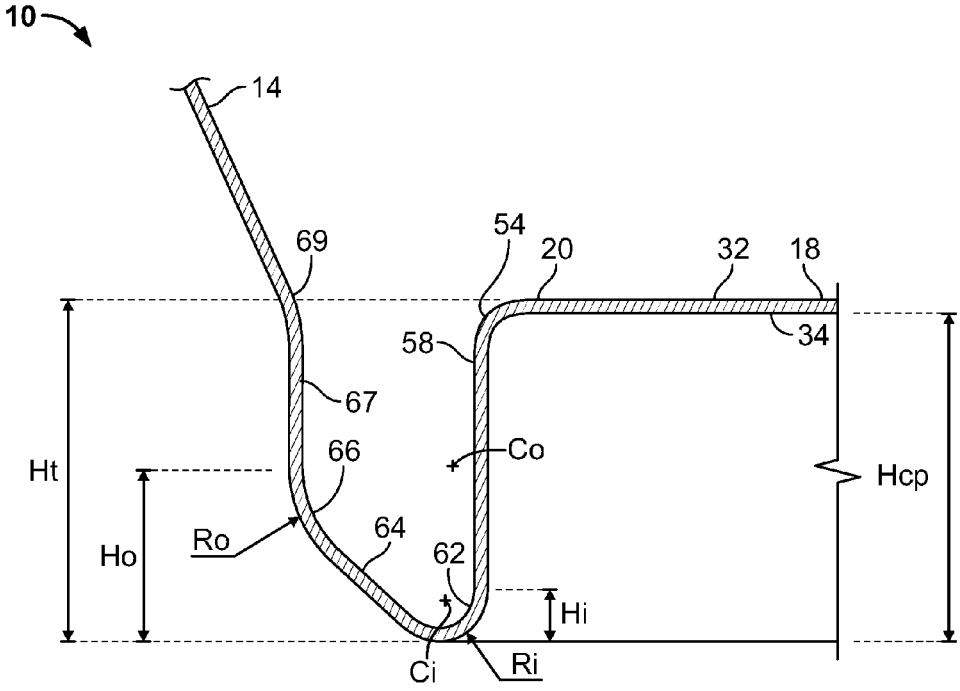
FIG. 3A is a magnified portion of the can end of FIG. 3.

The base further includes an annular short base wall 64 which has a first end joined, preferably directly connected, to the second end of the inner curved portion 62. The short wall 64 extends radially outwardly from the inner curved portion 62 as illustrated in FIG. 2 or both radially outwardly and angled upwardly as illustrated in FIG. 3, An annular outer curved portion 66 is joined to, preferably directly connected to as to be integral with, a second end of the short wall 64. The outer curved portion 66 extends upwardly relative to a lowermost end of the second portion 62. The outer portion is characterized by a radius of curvature $R_o$ having a center point $C_o$ which may located radially outwardly of the center point $C_i$ of the radius of curvature of the inner curved portion 62 (see FIG. 2A), radially inwardly of the center point $C_i$ of the radius of curvature of the inner curved portion 62 (see FIG. 3A), or the center points $C_i$ and $C_o$ may be equidistant from the vertical center axis. In each embodiment, the center point $C_o$ of the radius of curvature $R_o$ of the outer curved portion 66 has a higher vertical height than the center point $C_i$ of the radius of curvature $R_i$ of the inner curved portion 62.

An outer wall 67 is integral with an uppermost end of the outer curved portion 66 and extends upwardly therefrom. The outer wall 67 merges with a lowermost end of the wall 14 at a height about equal with the height $H_{cp}$ of the enter panel 18.

As illustrated in FIG. 3, when the short wall 64 is angled upwardly, the outer curved portion 66 is elevated relative to the inner curved portion 62. An uppermost height $H_o$ of the outer curved portion 66 is greater than a height $H_i$ of the inner curved portion 62 but less than the height $H_{cp}$ of the panel radius 54. The distance between the height $H_{cp}$ of the panel radius above the uppermost height $H_i$ of the inner curved portion 62 is greater than the distance between the uppermost height $H_o$ of the outer curved portion 66 above the height $H_i$ of the inner curved portion 62.

The circumferential wall 14 joins the countersink 16 with the curl 12 so that an uppermost portion 68 of the wall 14 is directly connected to the curl 12 and a lowermost portion of the wall 14 is directly connected to, as to be integral with, the outer wall 67. Accordingly, the circumferential wall 14 extends upwardly from the countersink 16. The circumferential wall 14 may be angled outwardly relative to the longitudinal axis 50 or have an arcuate segment. A transition 69 between an uppermost end of the outer wall 67 has a height $H_t$ substantially equal to the height $H_{cp}$ of the panel radius 54.

The curl 12 is located radially outwardly relative to the center panel 18 and defines an outer perimeter of the end 10. The curl 12 has an inner arcuate portion directly connected to an uppermost portion of the circumferential wall 14 and an outer portion that extends outwardly relative to the longitudinal axis 50.

The terms "first," "second," "upper," "lower," etc. are used for illustrative purposes only and are not intended to limit the embodiments in any way. The term "plurality" if used herein is intended to indicate any number greater than one, either disjunctively or conjunctively as necessary, up to an infinite number. The terms "joined" and "connected" as used herein are intended to put or bring two elements together so as to form a unit, and any number of elements, devices, fasteners, etc. may be provided between the joined or connected elements unless otherwise specified by the use of the term "directly" and supported by the drawings.

One of ordinary skill in the art would appreciate that the characteristics unique to the individual illustrated embodiments may be combined without departing from the spirit of the invention.

While the specific embodiments have been illustrated and described, numerous modifications come to mind without significantly departing from the spirit of the invention, and the scope of protection is only limited by the scope of the accompanying Claims.

What is claimed is:

1. A can end for a two-piece container, the can end comprising:

a center panel positioned about a vertical center axis, the center panel comprising a peripheral edge including a panel radius, the panel radius comprising a center of curvature below a product side of the center panel;

a countersink comprising an inner wall joined to the panel radius and extending downwardly relative thereto, a first curved portion having a first end joined to the inner wall, a short wall joined to a second end of the first curved portion and extending radially outwardly and substantially horizontally from the first curved portion, a second curved portion joined to the short wall and extending upwardly and radially outwardly therefrom, wherein the first curved portion has a first radius of curvature, and the second curved portion has a second radius of curvature, the second radius of curvature being greater than the first radius of curvature wherein the second radius of curvature has a center point located radially inwardly of a center point of the first radius of curvature;

a wall extending upwardly from the countersink; and a curl joined to the wall.

2. The can end of claim 1 wherein the countersink is recessed below the center panel.

3. The can end of claim 1 wherein the countersink is concave.

4. The can end of claim 1 wherein the first radius of curvature has a center point located radially outwardly of the peripheral edge of the center panel.

* * * * *